US006808437B2

(12) United States Patent
Podd et al.

(10) Patent No.: US 6,808,437 B2
(45) Date of Patent: Oct. 26, 2004

(54) EXTENDIBLE LINK SOFT OR PLUSH TOY

(75) Inventors: George Podd, Lake Forest, IL (US); Tim Copeland, Chicago, IL (US)

(73) Assignee: Senario LLC, McHenry, IL (US)

( * ) Notice: Subject to any disclaimer, the term of this patent is extended or adjusted under 35 U.S.C. 154(b) by 0 days.

(21) Appl. No.: 10/357,925

(22) Filed: Feb. 4, 2003

(65) Prior Publication Data

US 2004/0152395 A1 Aug. 5, 2004

(51) Int. Cl.[7] ..... A63H 3/36

(52) U.S. Cl. ..... 446/320; 446/308; 446/309; 446/380

(58) Field of Search ..... 446/320, 308, 446/311, 312, 44, 45, 59, 63, 64, 65, 380

(56) References Cited

U.S. PATENT DOCUMENTS

| | | | | |
|---|---|---|---|---|
| 1,408,001 | A | | 2/1922 | Hauck |
| 3,645,038 | A | * | 2/1972 | Morrison et al. |
| 4,169,336 | A | * | 10/1979 | Kuhn |
| 4,236,347 | A | * | 12/1980 | Fauls |
| 4,505,687 | A | | 3/1985 | Munro |
| 4,802,879 | A | | 2/1989 | Rissman et al. |
| 5,194,033 | A | | 3/1993 | Wright |
| 5,240,448 | A | | 8/1993 | Ishikawa |
| 5,267,886 | A | | 12/1993 | Wood et al. |
| 5,975,982 | A | * | 11/1999 | Spector ..... 446/397 |
| 6,074,265 | A | | 6/2000 | Barthold |
| 6,089,943 | A | | 7/2000 | Lo |
| 6,174,216 | B1 | | 1/2001 | Chianese |
| 6,312,307 | B1 | | 11/2001 | Dean, II |
| 6,413,142 | B1 | * | 7/2002 | Weastler ..... 446/320 |
| 2002/0164921 | A1 | | 11/2002 | Wilkinson et al. |

FOREIGN PATENT DOCUMENTS

| | | | |
|---|---|---|---|
| FR | 2610531 A1 | * | 8/1988 |
| WO | 93/18831 | | 9/1993 |

* cited by examiner

*Primary Examiner*—Derris H. Banks
*Assistant Examiner*—Ali Abdelwahed
(74) *Attorney, Agent, or Firm*—Pauley Petersen & Erickson

(57) ABSTRACT

A projectile plush toy including a body portion having a mass and a first extendible link. The first extendible link having a forward end portion and a rearward end portion. The rearward end portion connected to the body portion. The first extendible link extendible between a first position and a second position. In the second position, the forward end portion defines a first release point and the first extendible link biases the body portion towards the forward end portion. In the second position, a major mass portion of the plush toy is positioned at the rearward end portion of the first extendible link. In one preferred embodiment of this invention, the projectile plush toy further includes a second extendible link having a forward end portion and a rearward end portion connected to the body portion. The second extendible link is extendible between a first position and a second position. In the second position, the forward end portion defines a second release point and biases the body portion towards the forward end portion of the second extendible link. In the second position, a major mass portion of the plush toy is positioned at the rearward end portion of the second extendible link. A method for projecting the projectile plush toy is also disclosed.

14 Claims, 8 Drawing Sheets

EXTENDIBLE LINK SOFT OR PLUSH TOY

BACKGROUND OF THE INVENTION

1. Field of the Invention

This invention relates to a projectile soft or plush toy and a method for projecting the projectile soft or plush toy with respect to a forward end portion of an extendible link.

2. Discussion of Related Art

Many conventional projectile toys, such as glider plane sets, include a glider plane shaped as an actual fighter aircraft and a separate independent launching base connected to the glider plane by a household rubberband. Such glider planes are typically made of lightweight materials, such as thin wood pieces or foam material. Because of its light weight, the conventional glider plane may be difficult to launch and/or may not fly straight or over a relatively long distance, as is expected by the young user. Further, because the gilder plane's flight path is unpredictable, such projectile toys can be dangerous and cause injury to the user.

Other conventional projectile toys may be shaped as a small animal having a mass that is center about a launching base. Such conventional projectile toys may include an elastic element that is stretchable to project the animal a short distance through the air. Because the conventional projectile toy mass is centered or concentrated about the launching base, such projectile toys may not launch easily and/or may fly over a relatively short distance. Further, such conventional projectile toys do not include additional components for added entertainment. Thus, a child attention to the conventional projectile toy is limited.

There is an apparent need for a projectile soft or plush toy that is easy to operate and has increased performance.

There is also an apparent need for a projectile soft or plush toy that provides enjoyment for the user.

SUMMARY OF THE INVENTION

It is one object of this invention to provide a projectile extendible link plush toy that is easy to use and has increased performance.

It is another object of this invention to provide a projectile extendible link plush toy that provides the user with additional entertainment components.

The projectile soft or plush toy according to this invention may be a human figure having human characteristics and a plurality of body members, or any other suitable animal figure, having various characteristics and body members. For example, the projectile plush toy maybe a monkey, a gorilla or a frog. Preferably, the projectile plush toy is made of a soft, plush material suitable for projecting the toy through the air without causing injury to the users or bystanders.

The extendible link plush toy of the present invention preferably includes a head, a torso or body portion and at least one extendible link, such as an extendible limb. For example, in one preferred embodiment of this invention, the extendible link plush toy is a projectile monkey figure having two arms, each having a hand, and two legs, each having a foot.

The projectile monkey figure includes a body portion having a mass and at least one extendible link connected to the body portion. Preferably, but not necessarily, the extendible link is positioned within a limb, for example an arm, to prevent damage to the extendible link and/or injury to the user. It is apparent that the extendible link may be positioned within any limb, such as a leg, and connected to the body portion. The extendible link is made of an elastic or extendible material so that the extendible link can be stretched or extended a suitable distance for projecting projectile monkey figure. The extendible link includes a forward end portion and a rearward end portion connected to the body portion and is extendible between a first or relaxed position and a second or extended position. In the extended position, the forward end portion of the extendible link defines a release point and the extendible link biases the body portion towards the forward end portion. In the second position, a major mass portion of the projectile monkey figure, including the body portion mass, is positioned at the rearward end portion of the extendible link. By positioning the major mass portion of the projectile monkey figure mass at or near the rearward end portion of the extendible link, the projectile performance is maximized to project the projectile monkey figure through the air.

The projectile monkey figure may also include a second extendible link connected to the body portion and positioned within a limb, for example a second arm of the projectile monkey figure. The second extendible link includes a forward end portion and a rearward end portion connected to the body portion. The second extendible link is extendible between a first or relaxed position and a second or extended position. In the extended position, the forward end portion of the second extendible link defines a second release point and the second extendible link biases the body portion towards the forward end portion. In the second position, a major mass portion of the projectile monkey figure, including the body portion mass, is positioned at the rearward end portion of the second extendible link. By positioning the major mass portion of the projectile monkey figure mass at or near the rearward end portion of the second extendible link, the projectile performance is maximized to project the projectile monkey figure through the air.

An appendage, for example a hand, is preferably connected to each of the extendible links and is movable with respect to the body portion. Each appendage includes a holding device integrated with or attached to the appendage to receive a user's finger or thumb so that the appendage can be displaced with respect to the body portion by stretching or extending the extendible link. The holding device preferably includes a pocket made of a soft, comfortable but stable material that allows a user to insert his or her finger or thumb a suitable distance to prevent the finger or thumb from releasing or slipping from the pocket prior to launching or projecting the projectile monkey figure. Other suitable holding devices include, but are not limited to, a ring, a hook and a rod.

In one preferred embodiment of this invention, the first appendage holding device and the second appendage holding device are simultaneously displaced with respect to the body portion as the first extendible link and second extendible link are extended to the second position. For example, with the user's thumb inserted into the second appendage holding device, the second appendage holding device can be positioned within the first appendage holding device pocket. Thus, the first extendible link and the second extendible link are extended by pulling the body portion downwardly and away from the release points, with the first release point positioned at the second release point. In such a configuration, the major mass portion of the projectile monkey figure mass is positioned at the rearward end portion of the extendible links and away from the forward end portions of the extendible links in order to maximize launching and projectile performance.

The projectile monkey figure may include a sleeve that covers at least a portion of each extendible link. The sleeve can be segmented so that as the extendible link is extended, a second portion of the sleeve connected at the forward end portion of the extendible link, for example to the hand or appendage, moves with respect to a first portion of the sleeve connected to the body portion, allowing the extendible link to stretch or extend. As the extendible link is moved from the extended position to the relaxed position, the second portion moves towards the first portion to cover the extendible link. Additionally or alternatively, the sleeve is made of an elastic and/or gathered plush material that allows the extendible link to extend or stretch.

The projectile monkey figure also includes an independent module for a sound box that produces sound effects. Preferably, but not necessarily, the module is operated by a motion switch. The module activates a series of programmed sounds, for example monkey noises, as the projectile monkey figure is projected through the air.

In one preferred embodiment of this invention, a method for projecting a projectile plush toy is disclosed. The body portion is fixed in a launching position and at least one extendible link is extended to a second or extended position. For example, the user can grasp an appendage holding device with one hand and pull the body portion with the other hand to extend or stretch the corresponding extendible link. In the second position, a forward end portion of the extendible link defines a release point and with the body portion in the launching position, a major mass portion of the projectile plush toy mass is positioned at a rearward end portion of the extendible link connected to the body portion.

Potential energy is stored within the extendible link in the second position and the extendible link biases the body portion towards the forward end portion. The user releases his or her hold on the body portion to urge the body portion towards the forward end portion of the extendible link and project the projectile plush toy with respect to the forward end portion. In one preferred embodiment of this invention, a sound box module is activated at or shortly after the body portion is released. Preferably, but not necessarily, the sound box module is operated by a motion switch and activates a series of programmed sounds as the projectile plush toy is projected through the air.

BRIEF DESCRIPTION OF THE DRAWINGS

The above and other features and objects of this invention will be better understood from the following detailed description taken in view of the drawings, wherein.

DESCRIPTION OF PREFERRED EMBODIMENTS

Figure 1:
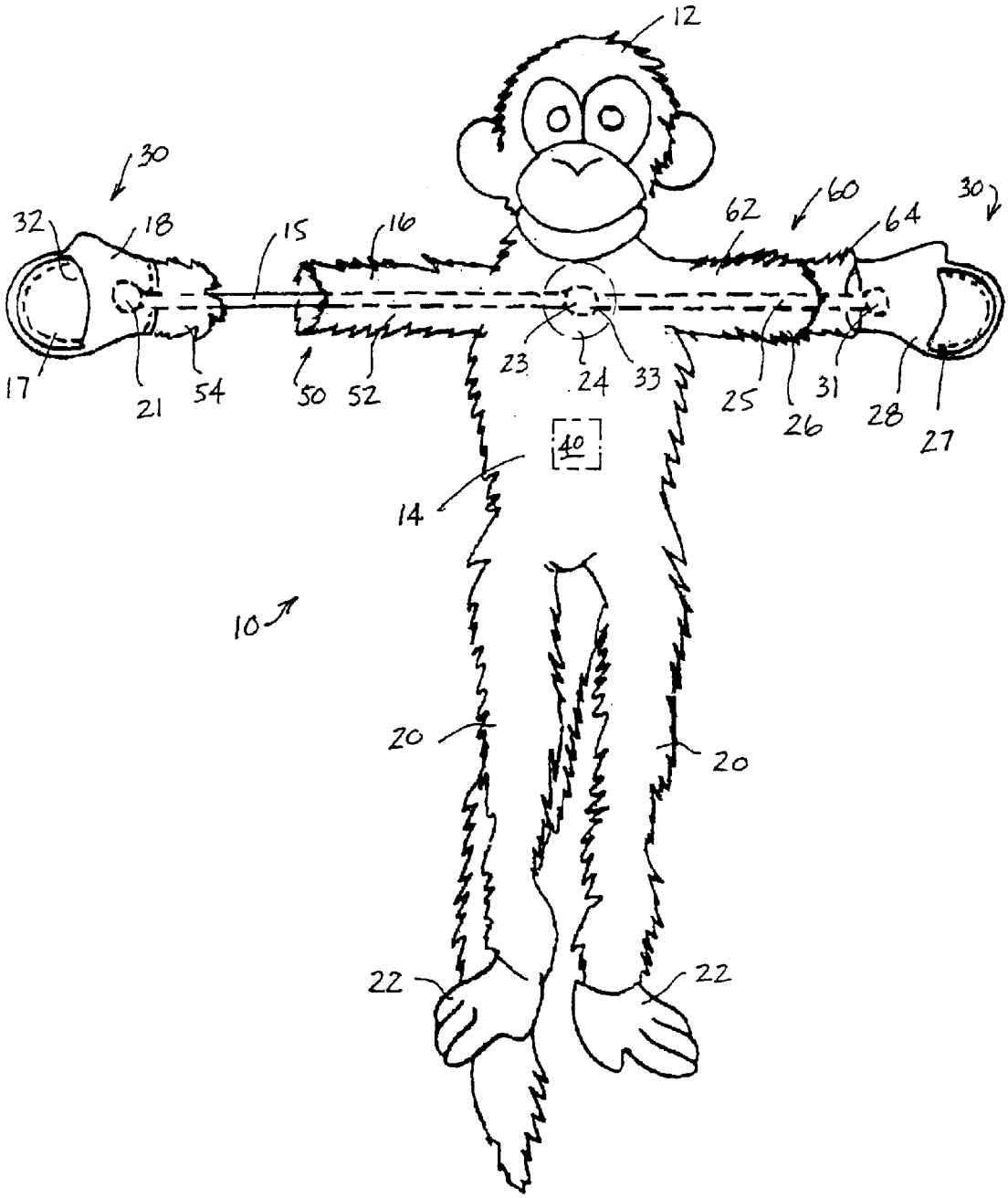
FIG. 1 is a front view of a projectile plush toy having an extendible link shown in an extended position, according to one preferred embodiment of this invention.

This invention is directed to a projectile soft or plush toy. The projectile plush toy may comprise a human figure or any other suitable animal figure, having various characteristics and body members. For example, the projectile plush toy may comprise a monkey, a gorilla or a frog. Preferably, the projectile plush toy is made of a soft, plush material suitable for projecting the toy through the air without causing injury to the user or bystanders. Preferably, the body members or parts of the projectile plush toy comprise a soft material, such as a synthetic fur material. A suitable filler material is preferably, but not necessarily, contained within the body portion, legs and tail for example. Such body member materials and filler materials are known to those having ordinary skill in the art.

Although the various aspects and embodiments of the present invention will be described in the context of a projectile plush toy, and more particularly described, without limitation and by way of illustration only, in the context of a projectile plush monkey FIG. 10, it is apparent that the teachings and methods of the present invention are equally adaptable to other projectile objects and methods for projecting the object.

FIGS. 1–5 illustrate a projectile monkey FIG. 10. Preferably, projectile monkey FIG. 10 comprises at least one of a head 12, a torso or body portion 14 and at least one limb. For example, projectile monkey FIG. 10, as shown in FIGS. 1–5, comprises a first arm 16 having a first hand 18, a second arm 26 having a second hand 28, and two legs 20 each having a foot 22.

Figure 2:
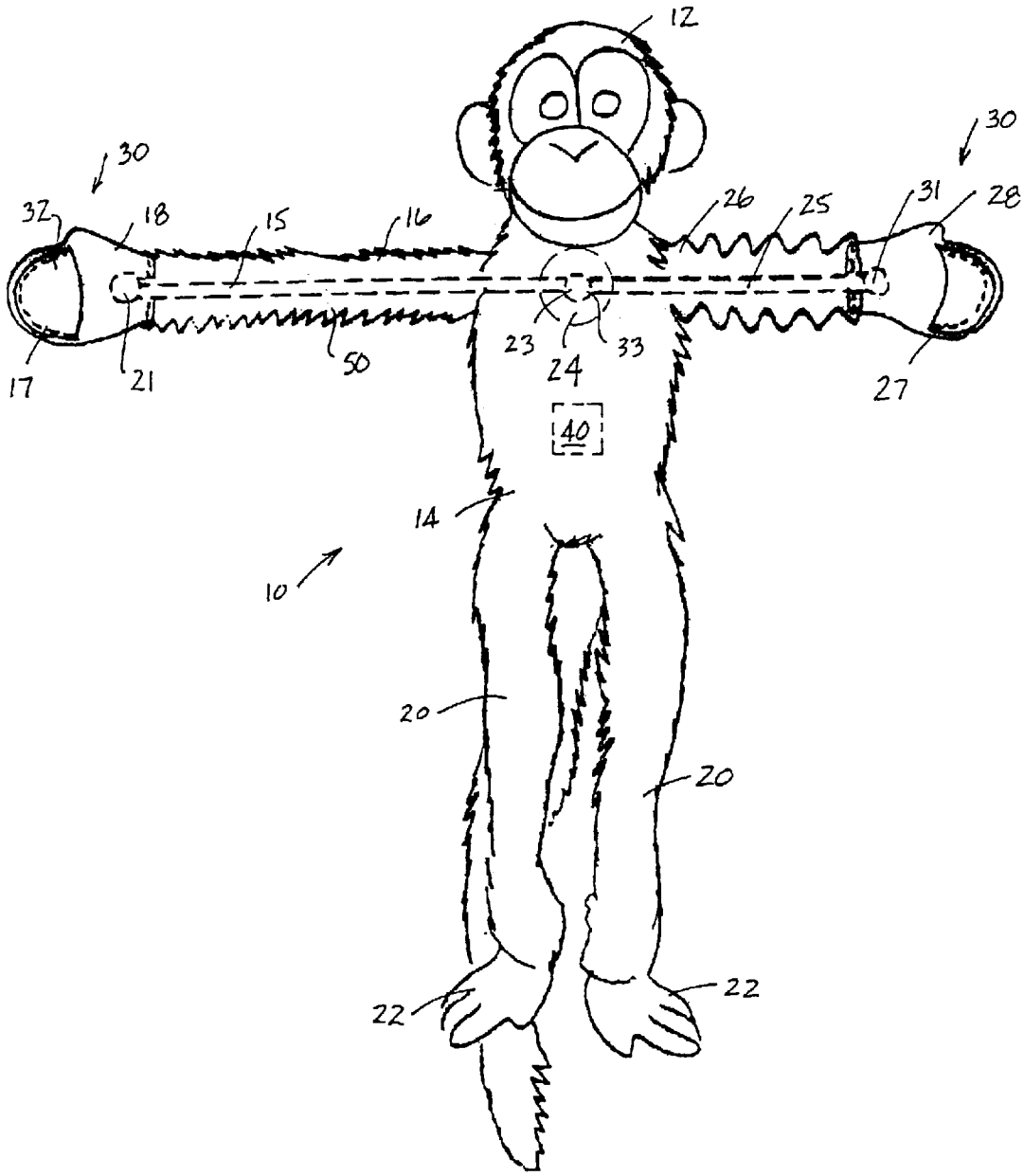
FIG. 2 is a front view of a projectile plush toy having an extendible link shown in an extended position, according to one preferred embodiment of this invention.

In one preferred embodiment of this invention, as shown for example in FIG. 1, projectile plush monkey FIG. 10 comprises a body portion 14 having a mass. At least one extendible link 15 is positioned with respect body portion 14. For example, a first extendible link 15 is connected to body portion 14 and preferably, but not necessarily, positioned within a first arm 16. It is desirable, although not necessary, to position first extendible link 15 within arm 16 to prevent damage to first extendible link 15 and/or injury to the user. As shown in FIGS. 1 and 2 for example, first extendible link 15 comprises a forward end portion 21 and a rearward end portion 23 connected or attached to body portion 14. First extendible link 15 can be connected to body portion 14 using any suitable mechanical connection known in the art. For example, first extendible link 15 may be fastened to body portion 14 using glue, staples, screws, stitching, ties and knots. Preferably, but not necessarily, first extendible link 15 is connected to body portion 14 at a center portion or area 24 of body portion 14, as shown in FIGS. 1 and 2. Preferably, first extendible link 15 is made of an elastic or extendible material so that first extendible link 15 can be stretched or extended a suitable distance for projecting plush monkey FIG. 10 according to preferred embodiments of this invention, discussed below. First extendible link 15 preferably comprises at least one of a rubber tubing, an elastic cord, a natural latex rubber material and a synthetic latex rubber material. Other suitable materials for first extendible link 15 are known to those having skill in the art in view of the teachings herein.

First extendible link 15 is extendible between a first or relaxed position and a second or extended position. In the second position, forward end portion 21 defines a release point and first extendible link 15 biases body portion 14 towards forward end portion 21. In the second position, a major mass portion of plush monkey FIG. 10 is positioned at rearward end portion 23, rearwardly of or behind forward end portion 21. The phrase major mass portion refers to a portion of a mass of plush monkey FIG. 10. The plush monkey figure mass includes a mass of the projectile monkey figure body members. Preferably, the major mass portion is greater than about 50% of the plush monkey figure mass, more preferably at least about 70%, and still more preferably at least about 90%. With the major mass portion positioned at rearward end portion 23, potential energy is stored within first extendible link 15 in the second position sufficient to project projectile monkey FIG. 10. First extendible link 15 biases the major mass portion, including body portion 14, towards forward end portion 21. Upon release of body portion 14, the major mass portion is urged towards forward end portion 21, and a momentum is generated. Thus, projectile monkey FIG. 10 can be projected a relatively long distance through the air.

In one preferred embodiment of this invention, as shown for example in FIG. 1, projectile monkey FIG. 10 comprises a second extendible link 25 connected to body portion 14 and preferably, but not necessarily, positioned within a second arm 26 of projectile monkey FIG. 10. Second extendible link 25 can be attached or connected to body portion 14 using suitable mechanical connections, such as discussed above in reference with connecting first extendible link 15 to body portion 14. It is desirable, although not necessary, to position second extendible link 25 within arm 26 to prevent damage to second extendible link 25 and/or injury to the user.

As shown in FIGS. 1 and 2 for example, second extendible link 25 comprises a forward end portion 31 and a rearward end portion 33 connected or attached to body portion 14. Second extendible link 25 can be connected to body portion 14 using any suitable mechanical connection known in the art. For example, second extendible link 25 may be fastened to body portion 14 using glue, staples, screws, stitching, ties and knots. Preferably, but not necessarily, second extendible link 25 is connected to body portion 14 at a center portion or area 24 of body portion 14, as shown in FIGS. 1 and 2. Second extendible link 25 is made of an elastic or extendible material so that second extendible link 25 can be stretched or extended a suitable distance for projecting plush monkey FIG. 10 according to preferred embodiments of this invention, discussed below. Second extendible link 25 preferably comprises at least one of a rubber tubing, an elastic cord, a natural latex rubber material and a synthetic latex rubber material. Other suitable materials for second extendible link 25 are known to those having skill in the art in view of the teachings herein.

Second extendible link 25 is extendible between a first or relaxed position and a second or extended position. In the second position, forward end portion 31 defines a release point and second extendible link 25 biases body portion 14 towards forward end portion 31. In the second position, the major mass portion of plush monkey FIG. 10 is positioned at rearward end portion 33, rearwardly of or behind forward end portion 31. With the major mass portion positioned at rearward end portion 33, potential energy is stored within second extendible link 25 in the second position sufficient to project projectile monkey FIG. 10. Second extendible link 25 biases the major mass portion, including body portion 14, towards forward end portion 31. Upon release of body portion 14, the major mass portion is urged towards forward end portion 31, and a momentum is generated. Thus, projectile monkey FIG. 10 can be projected a relatively long distance through the air.

A first appendage 17, for example hand 18, is connected at forward end portion 21 to first extendible link 15 using any suitable mechanical connection. Similarly, a second appendage 27, for example hand 28, is connected at forward end portion 31 to second extendible link 25 using any suitable mechanical connection, such as used to connect the extendible link to body portion 14. Preferably, first appendage 17 and second appendage 27 each has a mass substantially less than the body portion mass. For example, first appendage 17 and second appendage 27 preferably each has a mass less than about 15% of the body portion mass, more preferably less than about 10% of the body portion mass. Further, the first appendage mass is preferably about equal to the second appendage mass.

Referring to FIGS. 1 and 2, each of first appendage 17 and second appendage 27 comprises a holding device 30. For example, holding device 30 is integrated with or connected to the appendage to receive a user's finger or thumb so that first extendible link 15 and/or second extendible link 25 can be extended with respect to body portion 14 to the second position. Holding device 30 can comprise one of a ring, a hook, a rod and a pocket. It is apparent that other suitable holding devices known to those having ordinary skill in the art may be used to extend the extendible links 15, 25 with respect to body portion 14.

Figure 6:
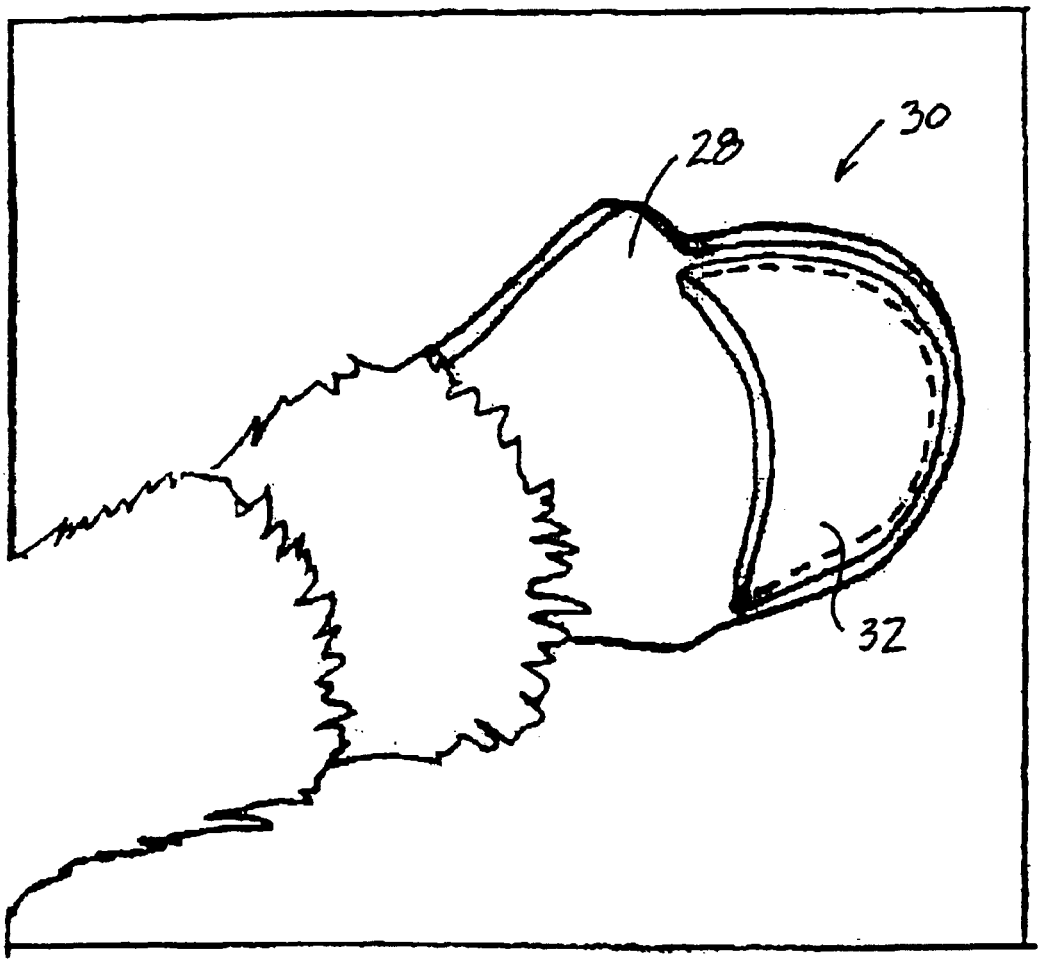
FIG. 6 is a front view of an appendage having a holding device, according to one preferred embodiment of this invention.

In one preferred embodiment of this invention, as shown in FIG. 6, holding device 30 comprises a pocket 32. Preferably, pocket 32 is stitched or sewn onto hand 18, 28 so that a user's finger or thumb can be inserted into and received by pocket 32. Preferably, pocket 32 is made of a soft, comfortable but stable material that allows the user to insert his or her finger or thumb a suitable distance and prevent the finger or thumb from releasing or slipping from pocket 32 prior to launching or projecting projectile monkey FIG. 10 with respect to forward end portion 21, 31.

Figure 8:
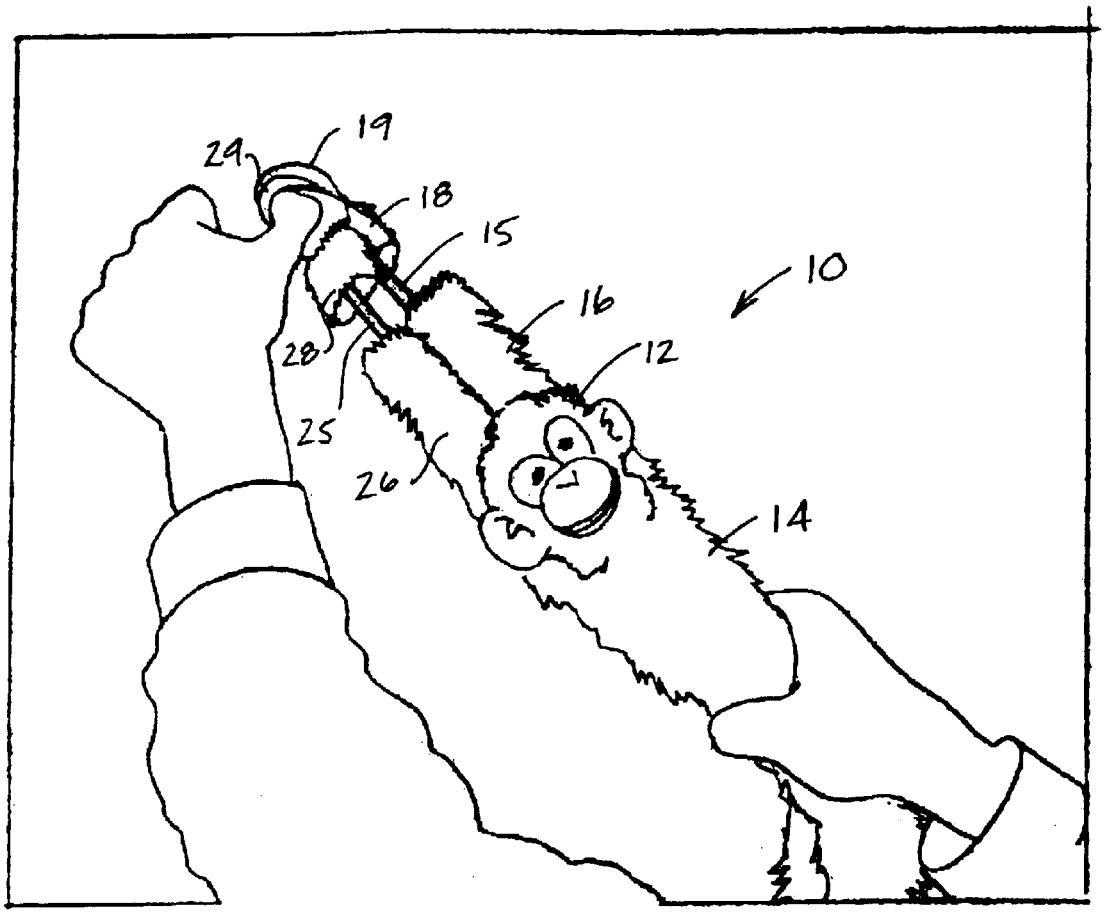
FIG. 8 is a front view of a projectile plush toy with two extendible links each in an extended position, according to one preferred embodiment of this invention.

In one preferred embodiment of this invention, first appendage holding device 30 and second appendage holding device 30 are simultaneously displaced with respect to body portion 14 to extend first extendible link 15 and second extendible link 25. For example, with the user's thumb inserted into second appendage holding device 30, second appendage holding device 30 may be positioned within first appendage holding device pocket 32. First extendible link 15 and second extendible link 25 are extended by pulling body portion 14 downwardly and away from the forward end portion 21, 31 with the first release point positioned at the second release point (FIG. 8). In such a configuration, the major mass portion of the projectile monkey figure mass, including the body portion mass, is positioned at rearward end portion 23, 33 opposite forward end portion 21, 31, respectively, in order to maximize launching and projectile performance. In the second position, extendible links 15, 25 each provides potential energy sufficient to project body portion 14 with respect to the forward end portions of the extendible links.

As shown in FIGS. 1 and 2 for example, in one preferred embodiment of this invention projectile monkey FIG. 10 comprises a first sleeve 50 covering at least a portion of first extendible link 15 and a second sleeve 60 covering at least a portion of second extendible link 25. Referring to FIG. 1, in one preferred embodiment of this invention, sleeve 50 is segmented and comprises a first portion 52 attached to body portion 14 and a second portion 54 attached at forward end portion 21 to first appendage 17. As first appendage 17 is displaced with respect to body portion 14 and first extendible link 15 is extended, second portion 54 moves with respect to first portion 52, allowing first extendible link 15 to extend. As first extendible link 15 moves from the extended position to the relaxed position, second portion 54 moves with respect to first portion 52, for example portions 52, 54 converge to cover first extendible link 15.

As shown in FIG. 1, sleeve 60 covering at least a portion of second extendible link 25 is similarly segmented and comprises a first portion 62 attached to body portion 14 and a second portion 64 attached at forward end portion 31 to second appendage 27. As second appendage 27 is displaced with respect to body portion 14 and second extendible link 25 is extended, second portion 64 moves with respect to first portion 62, allowing second extendible link 25 to extend. As second extendible link 25 moves from the extended position to the relaxed position, first portion 62 and second portion 64 converge to cover second extendible link 25.

Alternatively, as shown in FIG. 2 for example, in one preferred embodiment of this invention, sleeve 50 covering at least a portion of first extendible link 15 and sleeve 60 covering at least a portion of second extendible link 25 each comprises an elastic material, a gathered plush material and/or a synthetic knitted material that allows extendible links 15, 25 to extend or stretch. Preferably, sleeve 50 and sleeve 60 each is elastic and/or gathered sufficiently so that sleeve 50, 60 does not interfere with the extension or stretching of extendible link 15, 25, respectively. Elastic materials, gathered materials and knitted materials as well as methods for producing such materials suitable for use as sleeves 50, 60 are known to those skilled in the art.

In one preferred embodiment of this invention, projectile monkey FIG. 10 includes an independent module 40 for a sound box operatively connected to body portion 14 that produces sound effects. Preferably, module 40 is positioned within body portion 14, as shown schematically in FIGS. 1 and 2. In one preferred embodiment of this invention, module 40 is operated by a motion switch. Module 40 activates a series of programmed sounds, for example monkey noises, as projectile monkey FIG. 10 is projected through the air.

Figure 3:
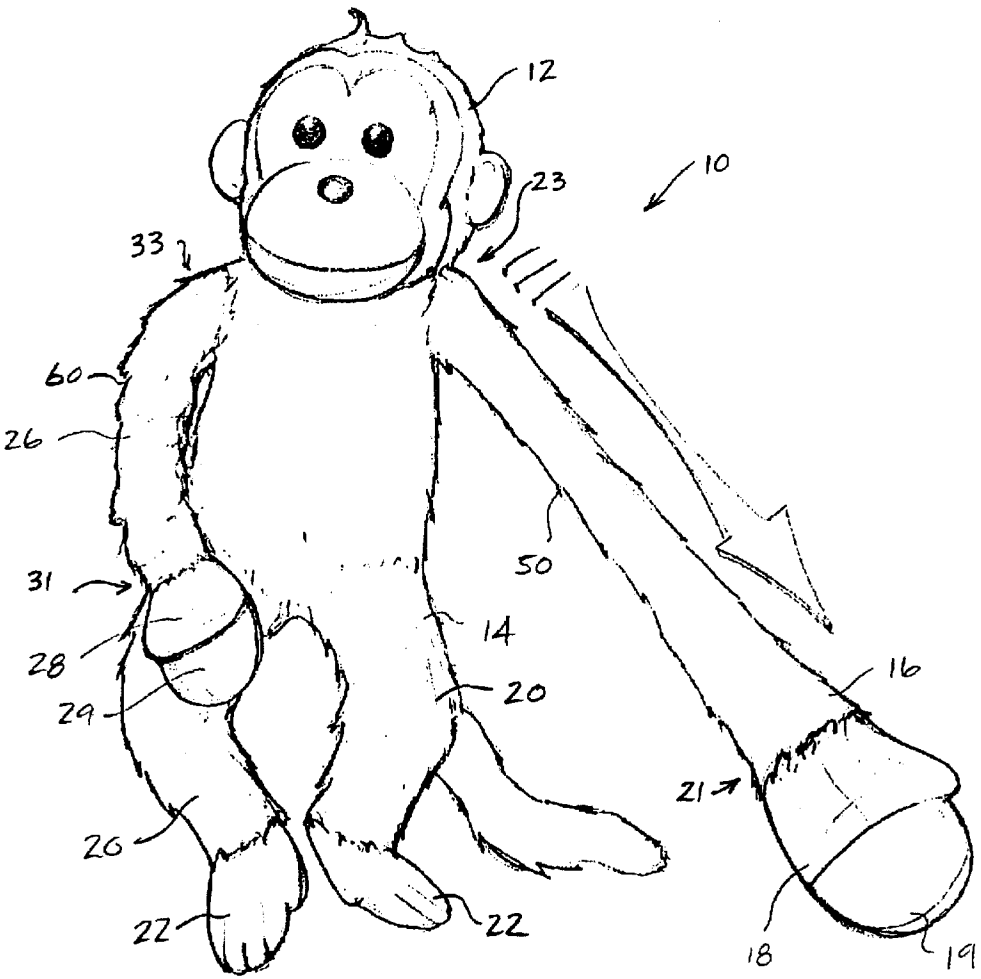
FIG. 3 is a perspective view of a projectile plush toy having an extendible link shown in an extended position, according to one preferred embodiment of this invention.
Figure 4:
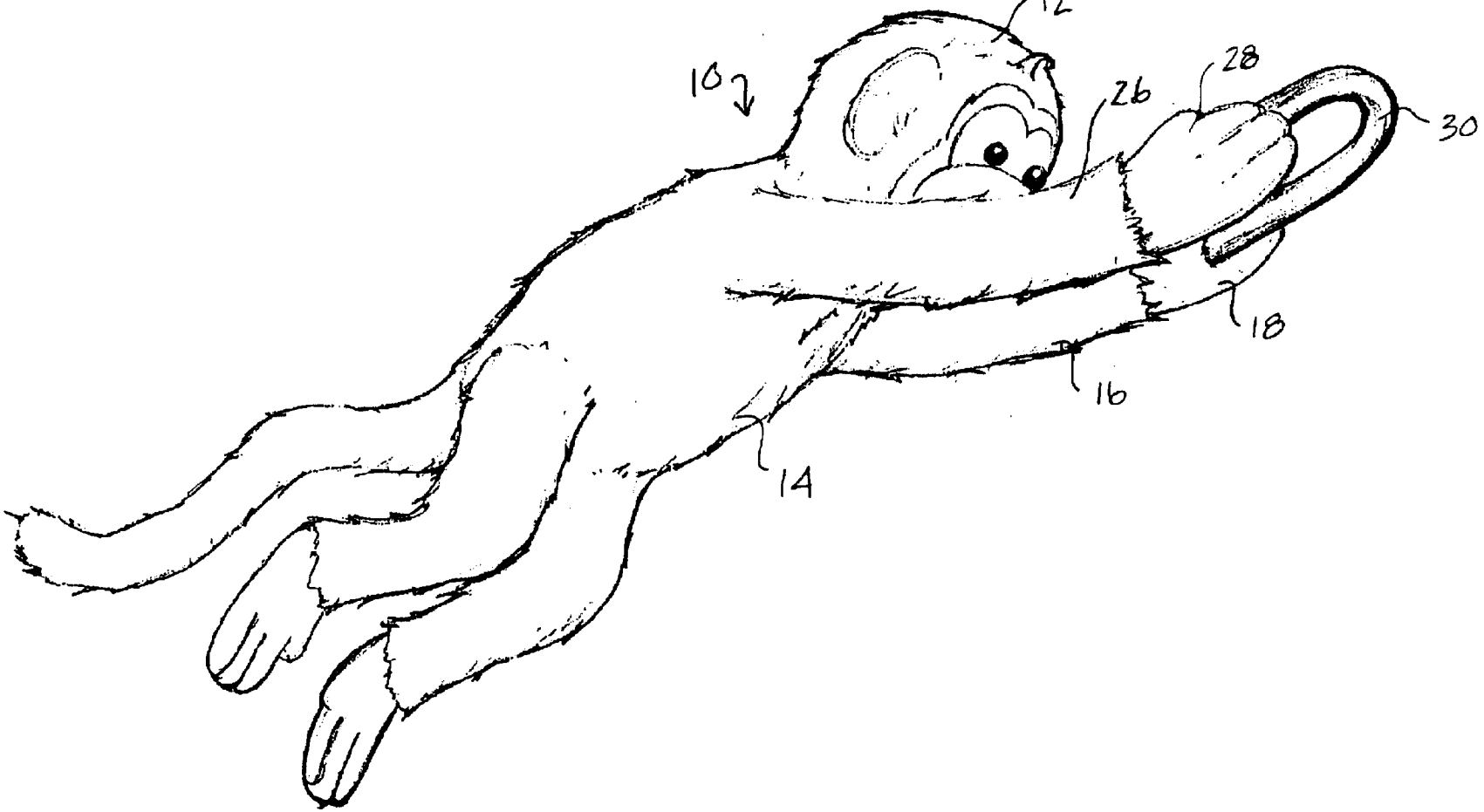
FIG. 4 is a perspective view of a projectile plush toy, according to one preferred embodiment of this invention.
Figure 5:
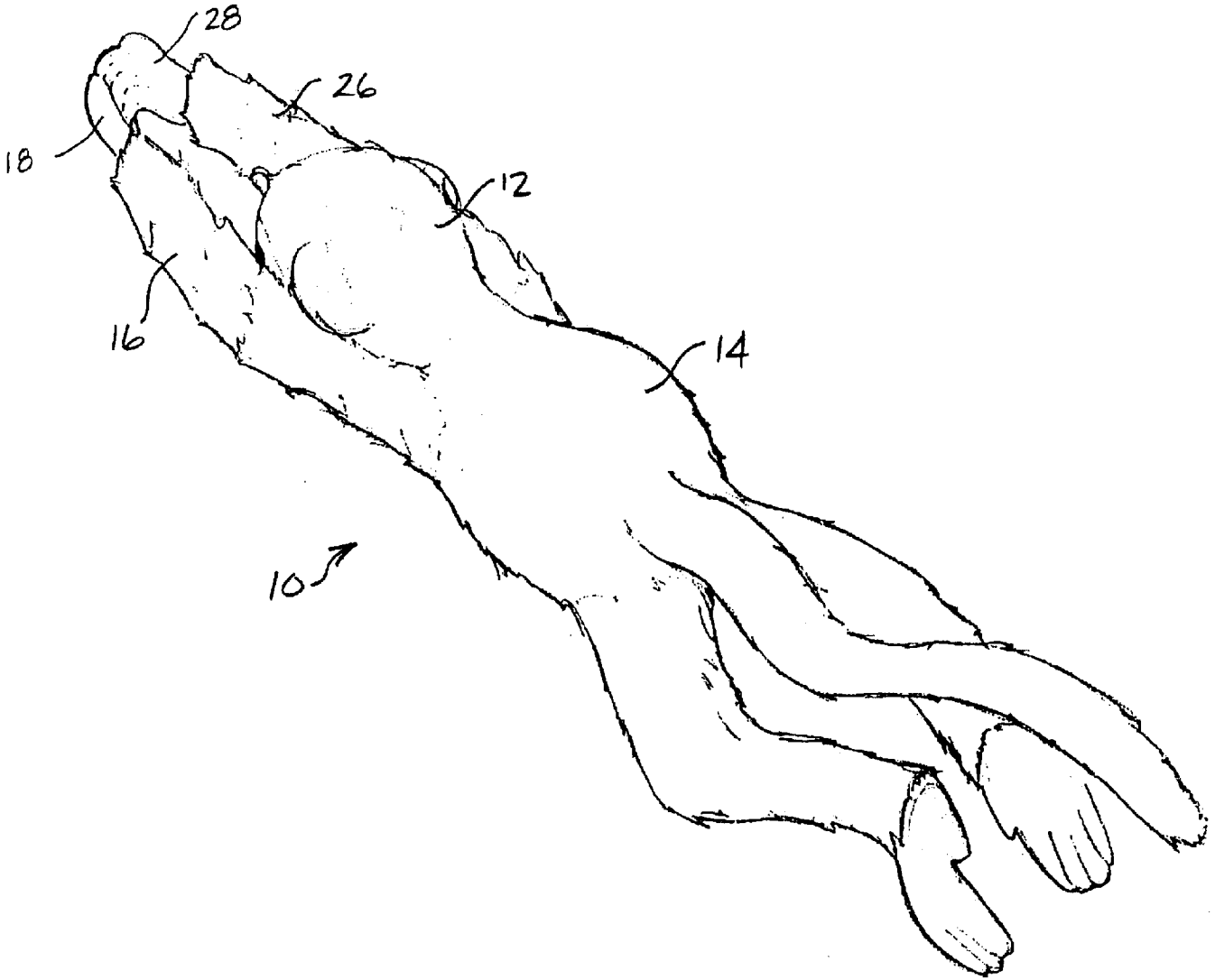
FIG. 5 is a perspective view of a projectile plush toy, according to one preferred embodiment of this invention.

Referring to FIGS. 3–5, in one preferred embodiment of this invention, projectile monkey FIG. 10 comprises body portion 14 having a mass and a first extendible arm 16 having a forward end portion 21 and a rearward end portion 23 opposite forward end portion 21. First extendible arm 16 is connected or attached to body portion 14 at rearward end portion 23. First hand 18 is attached to first extendible arm 16 and displaceable with respect to body portion 14. First extendible arm 16 is extendible between a first position and a second position. In the second position, forward end portion 21 of extendible arm 16 defines a first release point and first extendible arm 16 biases body portion 14 towards forward end portion 21. In the second position, a major mass portion of the projectile monkey FIG. 10 is positioned at rearward end portion 23 of first extendible arm 16. Preferably, first hand 18 comprises a first pocket 19 for receiving a user's thumb or finger, as shown in FIG. 3.

Projectile monkey FIG. 10 further comprises a second extendible arm 26 having a forward end portion 31 and a rearward end portion 33 connected or attached to body portion 14. Second extendible arm 26 is extendible between a first position and a second position. In the second position, forward end portion 31 defines a second release point and second extendible arm 26 biases body portion 14 towards forward end portion 31. In the second position, a major mass portion of the projectile monkey FIG. 10 is positioned at rearward end portion 33 of second extendible arm 26. A second hand 28 is attached to second extendible arm 26 and comprises a second pocket 29 for receiving a user's thumb or finger.

Projectile monkey FIG. 10 further comprises a first sleeve 50 positioned about first extendible arm 16 having a first portion attached to body portion 14 and a second portion attached to the first hand 18. A second sleeve 60 is positioned about second extendible arm 26 and has a first portion attached to body portion 14 and a second portion attached to second hand 28.

In one preferred embodiment of this invention, second hand 28 is insertable into first pocket 19, wherein the first release point is positioned at the second release point, so that projectile monkey FIG. 10 can be launched by extending both arms 16 and 26, simultaneously (FIG. 8). Alternatively, projectile monkey FIG. 10 can be projected by extending one arm 16 or 26 (FIG. 7).

In one preferred embodiment of this invention, first hand 18 is connected or attached to second hand 28, as shown in FIGS. 4 and 5. For example, first hand 18 may be operatively connected to second hand 28 using an extendible loop or tubing material (FIG. 4). Suitable extendible loop or tubing materials include those materials discussed above in reference to the extendible links 15, 25. Alternatively, first hand 18 may be stitched or sewn to second hand 28 (FIG. 5). It is apparent that other suitable connections can be used to connect first hand 18 with second hand 28.

Figure 7:
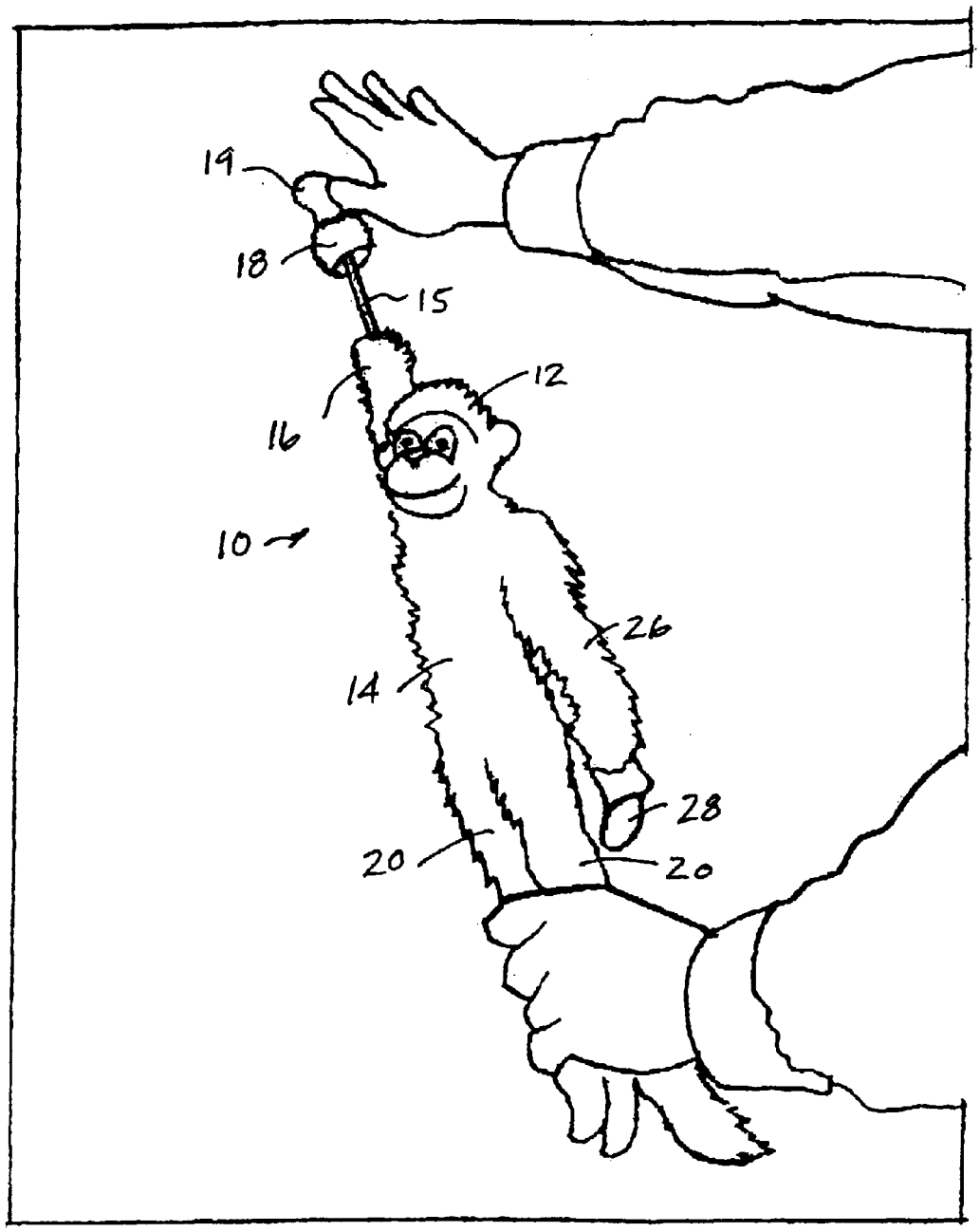
FIG. 7 is a front view of a projectile plush toy with one extendible link in an extended position, according to one preferred embodiment of this invention.

Referring to FIGS. 7 and 8, a method for projecting projectile monkey FIG. 10 according to one preferred embodiment of this invention begins with fixing body portion 14 in a launching position. At least one extendible link 15, 25 is extendible from a first or relaxed position to a second or extended position. Work is applied to first extendible link 15, for example, as first extendible link 15 is extended to the extended position. Additionally, or alternatively, work is applied to second extendible link 25 as second extendible link is extended to the extended position. In one preferred embodiment of this invention, extendible links 15, 25 are extended from the relaxed position to the extended position by the user grasping each appendage holding device with one hand, for example, inserting a thumb into pocket 19 and/or 29, and pulling body portion 14 with the other hand to extend extendible links 15, 25. A forward end portion 21, 31 of extendible links 15 and 25 are fixed at the second or extended position to define a release point. In the extended position, extendible link 15, 25 bias the major mass portion, including body portion 14, towards forward end portion 21, 31 and with body portion 14 in the launching position, the major mass portion of the projectile monkey figure mass is positioned at a rearward end portion 23, 33 of extendible links 15, 25.

Potential energy is stored within extendible links 15, 25 with extendible links 15, 25 fixed at the extended position and forward end portions 21, 31 defining the release point. The user releases his or her hold on body portion 14 to urge body portion 14 towards the forward end portions 21, 31 and project projectile monkey FIG. 10 with respect to forward end portions 21, 31. In one preferred embodiment of this invention, module 40 is activated at or shortly after body portion 14 is released. Preferably, but not necessarily, module 40 is operated by a motion switch and activates a series of programmed sounds, for example monkey noises, as projectile monkey FIG. 10 is projected through the air.

Although not shown in the figures, it is apparent from the teachings of this invention that in certain alternate embodiments of this invention, the extendible link may extend from first appendage 17 to second appendage 27, with or without attaching to body portion 14. Further, an extendible link may be connected to body portion 14 and positioned within at least one of legs 20, such that a corresponding foot 22 can be displaced with respect to body portion 14 and the extendible link is extendible between a first or relaxed position and a second or extended position and project projectile monkey FIG. 10.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A projectile plush toy comprising:

a body portion;

a first extendible arm having a forward end portion and a rearward end portion, the rearward end portion attached to the body portion;

the first extendible arm extendible between a first position and a second position, in the second position the forward end portion defining a first release point and the first extendible arm biasing the body portion towards the forward end portion, and in the second position a major mass portion of the plush toy positioned at the rearward end portion of the first extendible arm;

an independent module for a sound box operatively connected to the body portion having sound effects;

a second extendible arm having a forward end portion and a rearward end portion, the rearward end portion attached to the body portion;

the second extendible arm extendible between a first position and a second position, in the second position the forward end portion defining a second release point and the second extendible arm biasing the body portion towards the forward end portion, and in the second position a major mass portion of the plush toy positioned at the rearward end portion of the second extendible arm;

a first hand attached to the first extendible arm having a first pocket for receiving a user's thumb or finger; and a second hand attached to the second extendible arm having a second pocket for receiving a user's thumb or finger, the second hand is insertable into the first pocket.

2. The projectile plush toy of claim 1 wherein the module is operated by a motion switch.

3. The projectile plush toy of claim 1 wherein the first release point is positioned at the second release point.

4. The projectile plush toy of claim 1 wherein the first extendible arm and the second extendible arm each is connected to a center area of the body portion.

5. The projectile plush toy of claim 1 wherein each of the first extendible arm and the second extendible arm comprises at least one of a rubber tubing, an elastic cord, a natural latex rubber material and a synthetic latex rubber material.

6. The projectile plush toy of claim 1 wherein a mass of the second hand is about equal to a mass of the first hand.

7. The projectile plush toy of claim 1 further comprising a sleeve covering at least a portion of the first extendible arm.

8. The projectile plush toy of claim 7 wherein the sleeve is segmented and comprises a first portion attached to the body portion and a second portion attached at the forward end portion of the first extendible arm, wherein the first portion and the second portion converge to cover the first extendible arm.

9. The projectile plush toy of claim 7 wherein the sleeve comprises at least one of an elastic material, a gathered plush material and a synthetic knitted material.

10. The projectile plush toy of claim 7 further comprising a sleeve covering at least a portion of the second extendible arm.

11. The projectile plush toy of claim 10 wherein the sleeve is segmented and comprises a first portion attached to the body portion and a second portion attached at the forward end portion of the second extendible arm, wherein the first portion and the second portion converge to cover the second extendible arm.

12. The projectile plush toy of claim 10 wherein the sleeve comprises at least one of an elastic material, a gathered plush material and a synthetic knitted material.

13. The projectile plush toy of claim 1 wherein in the second position the first extendible arm has potential energy sufficient to project the body portion with respect to the forward end portion.

14. The projectile plush toy of claim 13 wherein in the second position the second extendible arm has potential energy sufficient to project the body portion with respect to the forward end portion.

* * * * *